US005790998A

United States Patent [19]

Crescimbeni

[11] Patent Number: 5,790,998

[45] Date of Patent: Aug. 11, 1998

[54] LEG POSITIONING DEVICE

[76] Inventor: Jayne A. Crescimbeni, 5746 Dickson Rd., Jacksonville, Fla. 32211

[21] Appl. No.: 856,941

[22] Filed: May 15, 1997

Related U.S. Application Data

[63] Continuation of Ser. No. 511,018, Aug. 3, 1995, abandoned.

[51] Int. Cl.[6] ..... A47C 20/00

[52] U.S. Cl. ..... 5/648; 5/651; 128/882

[58] Field of Search ..... 5/624, 648, 649, 5/650, 651; 128/882, 892, 893, 894

[56] References Cited

U.S. PATENT DOCUMENTS

| | | | |
|---|---|---|---|
| 2,709,435 | 5/1955 | Kress | 5/648 |
| 3,481,593 | 12/1969 | Allen et al. | 5/648 |
| 3,742,528 | 7/1973 | Münch | 5/648 |
| 3,853,121 | 12/1974 | Mizrachy et al. | 128/882 |
| 3,901,228 | 8/1975 | Brown | 5/651 |
| 4,482,138 | 11/1984 | Spann | 5/651 |

FOREIGN PATENT DOCUMENTS

| | | | |
|---|---|---|---|
| 0169091 | 10/1951 | Austria | 5/649 |

*Primary Examiner*—Brian K. Green
*Assistant Examiner*—Robert G. Santos
*Attorney, Agent, or Firm*—Thomas C. Saitta

[57] ABSTRACT

An orthopedic leg support is disclosed having a planar leg support surface angled at approximately 10 degrees relative to a generally horizontal base, with a calf recess, a heel recess and a channel connecting the calf recess and the heel recess to reduce or eliminate contact and pressure between the device and the calf, lower leg, ankle and heel of a patient. The device further incorporates lateral foot support walls and a sole support wall to prevent inward rotation, outward rotation and plantar flexion of the foot. The device is preferably composed of a semi-rigid foam material having some cushioning and compression characteristics.

17 Claims, 3 Drawing Sheets

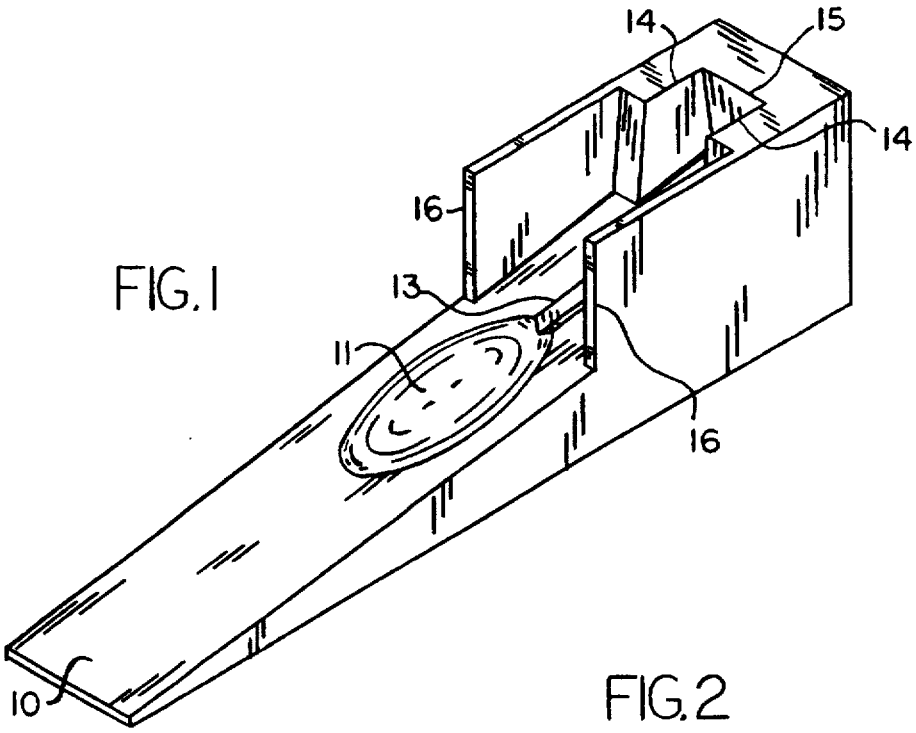
FIG. 1
FIG. 2
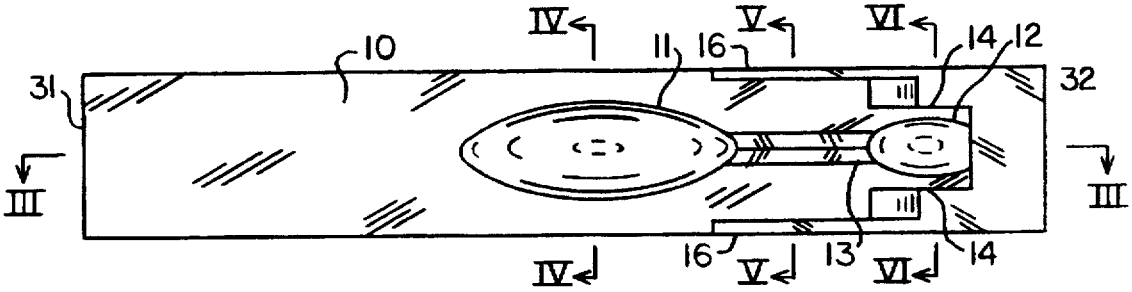

LEG POSITIONING DEVICE

This application is a continuation of application Ser. No. 08/511,018, filed Aug. 3, 1995, now abandoned.

BACKGROUND OF THE INVENTION

This invention relates generally to the field of orthopedic leg support devices, and more particularly to such devices designed to provide for full extension of the knee joint.

It is often necessary during recovery from lower extremity surgery or injury to provide a means for support of the leg of the patient which enhances rehabilitation by elevating the leg, maintaining it in a functional position and allowing for complete extension of the knee joint without placing undo pressure on the contact surfaces of the leg. Because such support devices must often be utilized for lengthy time periods, problems can arise due to the extended contact between the leg and the support. Blood vessels can be occluded, leading to deep venous thrombosis, and skin ulcerations can occur. These potential complications can greatly increase the time necessary for rehabilitation, reduce the maximum attainment level of complete rehabilitation, and may lead to the need for additional surgery in cases of skin ulceration and tissue necrosis such as debridement of necrotic tissue, delayed wound closure, skin grafts or even amputation.

To address these problems, supports have been developed which utilize semi-rigid expanded foam materials to better cushion the leg and convert pressure points to pressure areas. Unfortunately, some pressure points are difficult to avoid, since the leg must be supported in some manner. To reduce the complications from extended contact, devices have been developed which incorporate chambers or recesses to eliminate or reduce contact at certain points or in certain areas. For example, in U.S. Pat. No. 3,511,233 to Holy, Jr., a foot protector is shown which incorporates a heel recess. Likewise, in U.S. Pat. No. 4,482,138 to Spann, a leg support is shown which incorporates a knee depression and a heel recess. These two patents do not however eliminate the problems associated with prolonged support of the leg, as they do not address several main areas of pressure between the leg and support device, especially in a situation where it is desired that the leg be maintained in a fully extended position with the knee unflexed.

It is an object of this invention to provide an orthopedic leg support device which supports the leg in a non-flexed position, the device being designed to eliminate or reduce areas of pressure and contact between the leg, ankle and foot of the patient and the support surface of the device itself. It is a further object to provide such a device which eliminates or reduces pressure or contact over the entire region below the knee, including the foot. It is a still further object to provide such a device which incorporates means to prevent inward rotation, outward rotation or plantar flexion of the foot. Application of the device could effectively serve the patient in many instances such as when injuries such as malleolar fractures have been incurred, with tibial injury or osteotomy, in total knee arthroplasty, anterior cruciate ligament repair or reconstruction, with open reduction internal fixation surgical procedures of the lower extremity, in cases of neuropraxia, paresis or paralysis, in conditions mandating lower extremity elevation for an extended time period, with rehabilitation, and with cerebral vascular accident patients who must maintain positions which eliminate as much direct contact to the plegic body parts as possible.

SUMMARY OF THE INVENTION

The invention is a leg positioning device designed to provide support to the leg while simultaneously maintaining the knee joint in an unflexed, extended position and preventing undesired movement of the foot. The device comprises a flat bottomed main body with an angled leg support slope set at approximately 10 degrees, such that the foot is maintained at an elevation higher than the thigh. The leg support surface is planar and incorporates a calf recess, a heel recess and a channel connecting the two. The calf recess, heel recess and channel reduce, spread or eliminate direct contact between the device and the posterior side of the leg and foot without altering the anatomical alignment angle of the foot and leg, thereby reducing the possibility of complications developing from prolonged skin contact and interference with blood flow. Because the leg support surface is planar, the relaxed resting position of the leg will be in an unflexed alignment, with the knee joint fully extended. Lateral foot support walls and a sole support wall angled perpendicular to the leg support surface prevent unwanted rotation or flexion of the foot and ankle. The device is preferably constructed of a semi-rigid foam material having some compressibility and pliability for comfort. The device does not interfere or impinge on post-operative dressing and allows access for adjuvant orthopedic devices such as cryotherapy, pneumatic compression sleeves and antiemboletic stockings.

BRIEF DESCRIPTION OF THE DRAWINGS

FIG. 1 is a perspective view of the device.

FIG. 2 is a top view of the device.

DETAILED DESCRIPTION OF THE INVENTION

Figure 3:
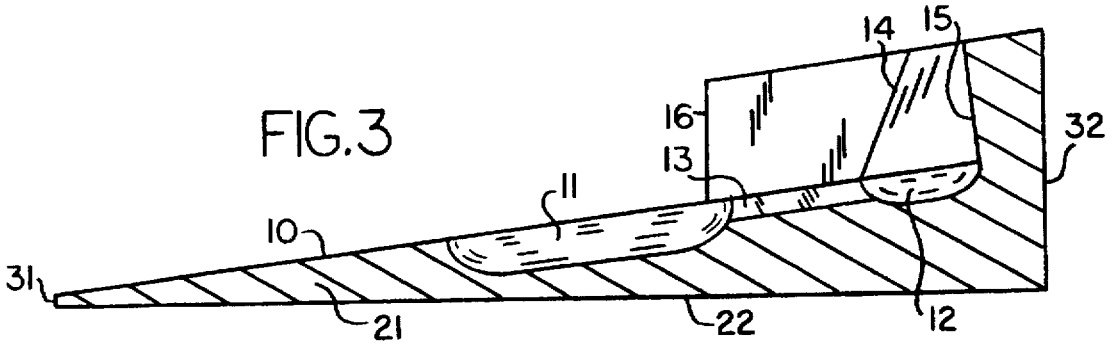
FIG. 3 is a cross-sectional side view of the device taken along line III—III of FIG. 2.

With reference now to the drawings, the invention will be described in detail with regard to the best mode and preferred embodiment. In general, the invention is a leg positioning device comprising a planar leg support surface or slope 10 angled relative to a generally planar horizontal base 22 of the main body 21, the leg support surface having a proximal end 31 and a distal end 32, a heel recess 12 positioned towards the distal end 32 on leg support surface 10, a calf recess 11 generally centrally located on leg support surface 10, and a channel 13 on leg support surface 10 connecting said heel recess 12 and said calf recess 11. Extending upward at the distal end 32 of leg support surface 10 is a sole support wall 15 and two lateral foot support walls 14. It is preferred that the device be composed of an expanded foam or cellular material, such as a foam polyurethane or the like, which provides support in a semi-rigid manner to the leg and foot while having some cushioning and compressibility characteristics for comfort. The density of the foam material should be sufficient to maintain its shape and provide the necessary support when in use without the need for additional structural components while concurrently imposing minimal pressure to the surface of the extremity.

As shown in FIGS. 1 and 3, the leg support surface 10 is angled relative to the horizontal base 22 of the main body 21 with the leg support surface 10 nearly touching the horizontal base 22 at the proximal end 31. Because of the angle, the leg support surface 10 at the distal end 32 is separated from the base 22 by several inches. In use, the proximal end 31 is placed under the upper or proximal aspect of the thigh of the patient with the foot resting at the distal end 32. In this manner the foot will be supported in an elevated position relative to the remainder of the patient's leg. It is preferred that the angle between the leg support surface and the horizontal base 22 be approximately 10 degrees. Leg support surface 10 is preferably planar, as the device is designed to maintain the knee joint of the leg in a fully extended and unflexed position through gravity alone without the need for leg restraints or conscious patient compliance. The planar leg support surface 10, since there are no pressure inducing lateral ridges as found in bent leg supports, also helps to reduce pressure and occlusion of the major blood vessels in the legs, the femoral and iliac veins, to help prevent deep venous thrombosis formation.

Figure 4:
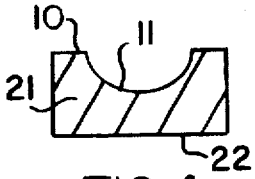
FIG. 4 is a cross-sectional end view of the device taken along line IV—IV of FIG. 2.

To further reduce occlusion of the blood vessels along the posterior aspect of the leg, and because the human leg is not planar, the device further comprises three separate recesses in the leg support surface 10. As shown in FIGS. 2, 3 and 4, a calf recess 11 is provided generally in the middle portion of the leg support surface 10, in the area where the calf of the patient would press down onto support surface 10. The calf recess 11 is preferably oval as shown and is sufficiently wide, long and deep to either eliminate or at least reduce contact between the leg support surface 10 and the calf. Preferably, the calf recess 11 is approximately 12 inches in length, 6 inches in width and 4¼ inches in depth at its deepest.

Figure 5:
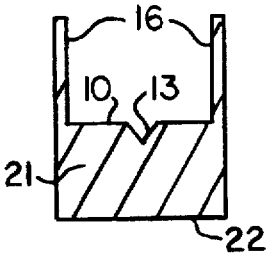
FIG. 5 is a cross-sectional end view of the device taken along line V—V of FIG. 2.
Figure 6:
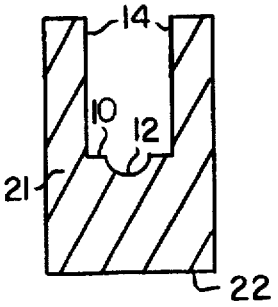
FIG. 6 is a cross-sectional end view of the device taken along line VI—VI of FIG. 2.
Figure 7:
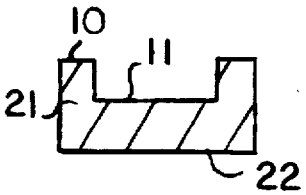
FIG. 7 is a view similar to FIG. 4, showing a rectangular calf recess.
Figure 8:
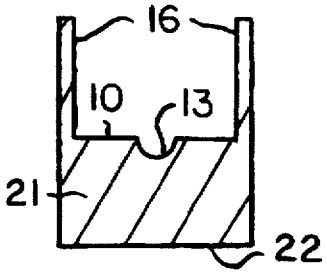
FIG. 8 is a view similar to FIG. 5, showing a U-shaped channel.
Figure 9:
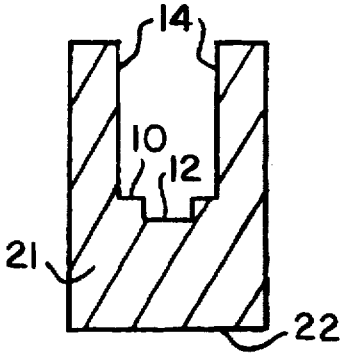
FIG. 9 is a view similar to FIG. 6, showing a ectangular heel recess.

A second recess is the heel recess 12, seen in FIGS. 2, 3 and 6, which is located at the distal end 32 of the leg support surface 10. The heel recess 12 likewise reduces blood vessel occlusion and ulceration from prolonged direct contact between the patient's heel and the support surface 10. The heel recess 12 is preferably oval, although it can be rectangular or of any shape which promotes reduced contact, and is preferably sized to completely eliminate contact between the heel and planar surface 10 of the device. Heel recess 12 is approximately 3¾ inches in width and extends from the distal end of channel 13 to the sole foot support 15. To further spread the contact pressure of the lower leg and ankle region, a channel 13 is provided which connects the heel recess 12 to the calf recess 11. This channel 13, preferably in a V-shaped configuration as shown in FIGS. 2, 3 and 5, although U-shaped or other configurations are possible, cradles the posterior region of the ankle and lower leg while eliminating direct contact along the most posterior aspect, thus distributing the area of contact over a wider portion of the device to reduce contact pressure at any given point. The channel 13 is preferably at least ½ inches wide where it contacts the leg support surface and also preferably as deep as it is wide, and is most preferably approximately 1½ inches deep and 1½ inches wide at the top.

In order to restrict movement of the foot itself, which can cause undesired rotation of the knee joint and leg, two lateral foot support walls 14 extend above the leg support surface 10 to either side of the heel recess 12. The lateral foot support walls 14 are sufficiently rigid to prevent undesired or non-conscious inward or outward rotation of the foot, but preferably are suitably pliant to allow for the performance of isometric exercises by the patient. Additionally, a sole support wall 15 extends upward from the leg support surface 10 at its distal end 32. The sole support wall 15 is preferably perpendicular to the leg support surface 10, as shown in FIG. 3. The sole support wall 15 works in a manner similar to the lateral support walls 14 to prevent undesired or uncontrolled plantar flexion (pointing of the foot). To further limit foot rotation and to provide better vertical support to the lateral support walls 14, side wall extensions 16 may be positioned along the outer edges of the leg support surface 10.

It is understood that equivalents and substitutions may be obvious to those skilled in the art, and the true scope and definition of the invention therefore is to be as set forth in the following claims.

I claim:

1. A leg positioning device for supporting and maintaining the knee joint of a leg in an unflexed position and for restricting lateral and plantar flexion of the foot, said leg comprising a calf, lower leg, and ankle, each having a posterior aspect and a most posterior aspect, said foot comprising a heel having a posterior aspect, said device comprising a main body having a generally horizontal base and a leg support surface comprising a sloped, generally planar upper surface, a calf recess positioned in said leg support surface for receiving the posterior aspect of the calf of the leg, a heel recess positioned in said leg support surface for receiving the posterior aspect of the heel of the foot, wherein said leg support surface slopes upwardly from said calf recess to said heel recess an open channel positioned in said leg support surface extending from said calf recess to said heel recess for receiving the posterior aspect of the ankle and lower leg, said open channel configured to support the posterior aspect of the ankle and lower leg therein with no direct contact between said channel and the most posterior aspect of the ankle and lower leg, two lateral foot support walls extending upward from said leg support surface on either side of said heel recess, and a sole support wall extending upward from said leg support surface between said lateral foot support walls.

2. The device of claim 1, where said heel recess is sized to eliminate contact between the heel and the leg support surface.

3. The device of claim 1, where said calf recess is sized to eliminate contact between the calf and the leg support surface.

4. The device of claim 1, where said channel is V-shaped.

5. The device of claim 1, where said channel is U-shaped.

6. The device of claim 1, where said heel recess is oval.

7. The device of claim 1, where said heel recess is rectangular.

8. The device of claim 1, where said calf recess is oval.

9. The device of claim 1, where said calf recess is rectangular.

10. The device of claim 1, where said main body is composed of a semi-rigid foam material.

11. The device of claim 10, where said foam material is polyurethane.

12. The device of claim 1, where said sole support wall extends at an angle perpendicular to said leg support surface.

13. The device of claim 1, where said leg support surface is sloped at an angle of approximately 10 degrees relative to said horizontal base.

14. The device of claim 1, where said open channel is at least ½ inch wide where it contacts said leg support surface.

15. The device of claim 1, where said open channel is as deep as it is wide.

16. The device of claim 1, where said open channel is approximately 1½ inches wide and 1½ inches deep.

17. A leg positioning device for supporting and maintaining the knee joint of a leg in an unflexed position and for restricting lateral and plantar flexion of the foot, said leg comprising a calf, lower leg, and ankle, each having a posterior aspect and a most posterior aspect, said foot comprising a heel having a posterior aspect, said device comprising a main body having a generally horizontal base and a sloping, generally planar, leg support surface, a calf recess positioned approximately in the middle of said leg support surface for receiving the posterior aspect of the calf of the leg, a heel recess positioned adjacent the upper end of said leg support surface for receiving the posterior aspect of the heel of the foot, wherein said leg support surface slopes upwardly from said calf recess to said heel recess an open channel positioned in said leg support surface extending from said calf recess to said heel recess for receiving the posterior aspect of the ankle and lower leg, said open channel configured to support the posterior aspect of the ankle and lower leg therein with no direct contact between said channel and the most posterior aspect of the ankle and lower leg, two lateral foot support walls extending upward from said leg support surface on either side of said heel recess, and a sole support wall extending upward from said leg support surface between said lateral foot support walls.

* * * * *